United States Patent [19]

Meury

[11] Patent Number: 5,059,852

[45] Date of Patent: Oct. 22, 1991

[54] PIEZOELECTRIC MECHANISM FOR GAS LIGHTERS

[75] Inventor: Marcel Meury, Tarragona, Spain

[73] Assignee: LaForest, S.A., Arragona, Spain

[21] Appl. No.: 427,569

[22] Filed: Oct. 25, 1989

[30] Foreign Application Priority Data

Aug. 2, 1989 [ES] Spain ..... 8902741

[51] Int. Cl.[5] ..... H01L 41/08

[52] U.S. Cl. ..... 310/339; 361/260

[58] Field of Search ..... 310/328, 339, 319; 361/260; 431/255

[56] References Cited

U.S. PATENT DOCUMENTS

| | | | |
|---|---|---|---|
| 3,457,461 | 7/1969 | Steinke et al. | 310/339 X |
| 4,015,152 | 3/1977 | Mohr | 310/339 |
| 4,139,792 | 2/1979 | Kondo | 310/339 |
| 4,315,180 | 2/1982 | Kondo et al. | 310/339 X |
| 4,422,124 | 12/1983 | Challet | 310/339 X |
| 4,608,508 | 8/1986 | Ohnishi | 310/339 |

FOREIGN PATENT DOCUMENTS

| | | | |
|---|---|---|---|
| 1218207 | 1/1971 | United Kingdom | 310/339 |

*Primary Examiner*—Mark O. Budd

*Attorney, Agent, or Firm*—Darby & Darby

[57] ABSTRACT

Of the type that include two telescopic bodies (1, 2) aided by a spring (17) which keeps them extended, there being inside the former the piezoelectric element (3) immobilized between an anvil (4) and the stop piece (6) upon which a firing hammer (8) strikes generating the spark.

The outside telescopic body (2) includes a pair of ribs (22) which emerge from diametrically opposite points of the cylindric surface of its axial recess, which guide the telescopic displacement of the other body (1) upon introducing themselves in respective longitudinal grooves (12) of the body, in which the diametric projections (10) of the guide of the firing hammer (8) play.

The body (2) has in its end opposite the emergence of the body (1) with a widened axial recess where there is a pair of confronting windows in which a cover (14) is secured in which springs (13, 17) which aid the firing hammer and telescopic body (1) are included.

3 Claims, 7 Drawing Sheets

B-B

A-A

PIEZOELECTRIC MECHANISM FOR GAS LIGHTERS

OBJECT OF THE INVENTION

The present invention, as is expressed in the title of this specification refers to a piezoelectric mechanism for gas lighters.

The piezoelectric mechanism that the invention proposes furnishes a series of advantageous features in view of the ones that present similar type piezoelectric mechanisms have, all of which in general lines include the following components:

On the one hand, a pair of telescopic bodies which are mutually aided by a spring which keeps them in the position of maximum extension, limited by a stop which prevents accidental separation thereof. Fixed solidly to one of these bodies, indistinctly, there is the piezoelectric element which provides the spark when a compression force or impact acts on it, in this case impact. This piezoelectric element is in turn located between an express metal piece called an anvil and another piece which is really the one which receives the impact of the firing hammer which displaces and guides in the inside of the telescopic unit.

The firing hammer is located in the resting condition of the mechanism, in a position far from the piezoelectric element because there are retention means which we will comment on later on. When a manual force of compression is exerted on the telescopic unit to cause the withdrawal, overcoming the action of the back spring, simultaneously the compression of a second spring which aids the firing hammer takes place and in the final phase of the telescopic run the release of the firing hammer is produced so that it can hit against the piezoelectric element.

The guide means of the firing hammer are defined by a pair of confronting longitudinal grooves which cross the wall of one of the tubular bodies, in which both diametric projections of the firing hammer play.

The retention means of the firing hammer in the position away from the piezoelectric element, or in the rest position are determined in all cases by both notches open on one side of the respective longitudinal groove of said tubular body, where they introduce themselves upon the firing hammer being forced to make a rotation movement.

The means that induce the rotation of the firing hammer in the direction in which the release of the retention means is produced as well as in the direction in which the recovery of the first position or reset position takes place, the rotation takes place upon hitting against the diametric projections of the firing hammer, the edges in ramp of both windows foreseen in the other telescopic body where said projections play.

An object of the invention is to obtain that the inside and outside telescopic bodies have a symmetric and easily manufactured geometry to avoid the difficulty in assemblying the firing hammer, as well as to be able to effect partial assemblies of the component parts which makes it possible to lower costs.

Another object of the invention is to reduce the electric resistance of the electric circuit in which the spark is generated upon closing the circuit with the least number of possible elements and with the shortest way.

The automatization of the assembly of the mechanism is facilitated upon being able to accede with part of the component parts by the two ends of the telescopic unit upon foreseeing in the outside telescopic body a body which fits in after assembly. The latter makes the cost of injection of this piece drop, aside from the material of the anchorable cover which defines the bottom does not need to be of conductor plastic.

BACKGROUND OF THE INVENTION

Presently, although the outer contour of the telescopic unit is generally square, since there does not have to be relative rotation between both, in some cases the inside section of the outside body and the outside contour of the inside body is circular, which implies a subsequent assembly of the diametric projections of the firing hammer, which is carried out by means of an insertable pin which is introduced in a diametric hole of the hammer, this operation must be carried out after the introduction of the firing hammer, simultaneously to the compression effected on the springs which aid the firing hammer and the telescopic unit. The assembly of this pin considerably increases the manufacturing costs of the piece itself and those of assembly of the mechanism.

Other present devices foresee a section different from the circular one in the outside and inside contour respectively in order to permit the introduction of a firing hammer which has the radial projections obtained simultaneously with it, but due to the fact that it has to be rotated in another position in which these projections are retained in the wall of said body and emerge through the windows existing in the other telescopic body, this all leads to a notable cost increase in the obtainment of some unsymmetric forms and therefore difficult to mold. These last present devices are inherently difficult to assemble due to the fact that all the components have to be coupled in a single direction, without partial assembles being previously effected. Besides, upon the outside telescopic body being where the springs are located, the body being of a single piece, the material has to be conducting which makes the product more expensive.

DESCRIPTION OF THE INVENTION

In order to solve all the above-cited inconveniences in accordance with the invention the outside telescopic body has a pair of ribs in the inside mouth, which emerge from diametrically opposite points, partially covering the axial cylindric recess to determine nonrotating guide means for the circular section of the inside telescopic body in which both longitudinal grooves are foreseen, thus acquiring a respective compartment of cotter and cotter way in opposite generants. The diametric projections of guide of the firing hammer also play in the longitudinal grooves of the inside telescopic body, these projections which can be retained in both notches open on one side of the groove and situated close to the inside end.

Said outside telescopic body has in its end opposite the outlet of the other body a widening of its cylindric axial recess, which has a square section just like the outside contour of this telescopic body, therefore defining a perimetric wall of an identical section where a cover which closes in a totally secure manner will remain connected and fit, the elements introduced through this end facilitate assembly.

This cover can be made out of a cheaper material than the rest of the outside telescopic body of which it forms part, since it need not be of conductor plastic as we will explain further on with reference to the figures.

The confronting windows which exist in the outside telescopic body whose active edges cause the rotation of the firing hammer in order to achieve its firing as well as its resetting extend in a direction axial to both sections, circular and square, of the inside periphery of the body, which makes it possible to assemble the firing hammer from the side where the cover will be located. In a transversal direction, these windows are displaced very assymetrically towards the side in which the respective diametric projection of the firing hammer is located, in the rest position of the mounted mechanism, absorbing the width of the longitudinal groove of the inside telescopic body.

The cover has a tubular neck with a square section which adjusts to the inside contour of the outside tubular body in which it penetrates. The retention is effected upon foreseeing a pair of triangular projections in two of its opposite surfaces, which are introduced in respective opposite windows made in the wall of the body. The neck or side wall of the cover also has a pair of grooves opposite each other and coinciding with the longitudinal grooves that exists in the inside telescopic body, there also being an oblique section which partially eliminates the wall to one side of the groove to leave the respective window in which the diametric projection of the firing hammer plays.

In order to facilitate the understanding of the features of the invention and forming an integral part of this specification, a series of drawings in whose figures the following has been represented in an illustrative and non-restrictive manner is accompanied.

DESCRIPTION OF THE PREFERRED EMBODIMENT

Figure 9:
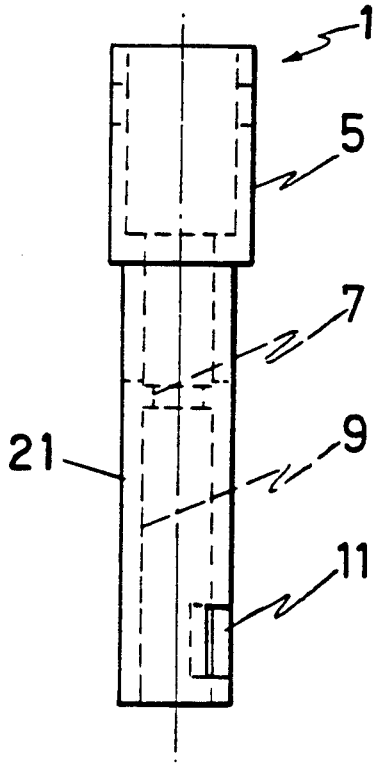
FIG. 9. It is a raised view of the inside telescopic body
Figure 11:
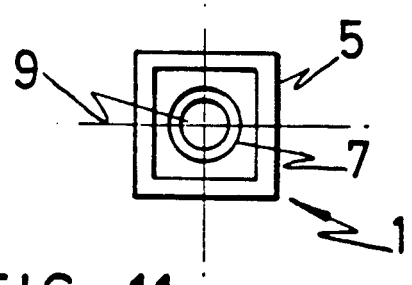
FIG. 11. It is a plan view of what is shown in FIG. 9.

Making reference to the numbering that is indicated in the above-mentioned figures, we can see that the piezoelectric mechanism for gas lighters which constitutes the object of the invention has like others of its type two telescopic bodies referred to in this case with numbers 1 and 2, the inside body being no. 1 and the outside body being no. 2. The piezoelectric element 3 is immobilized inside the inside telescopic body 1, resting on the anvil 4 which remains solidly anchored to the square portion 5 of said body 1, as is clearly seen in FIGS. 1 and 2. The other end of the piezoelectric element 3 is retained by piece 6 which in turn rests on the annular rib 7 of the axial recess of this inside telescopic piece 1. The firing hammer 8 which is displaced guided in the cylindric axial recess 9 of the body 1 (see FIG. 9) hits this piece 6.

Figure 15:
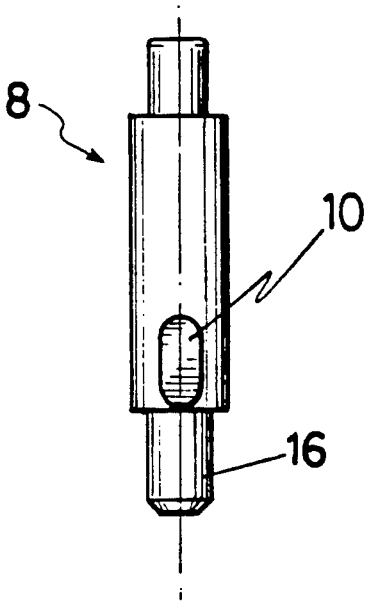
FIG. 15. It is a side raised view of the firing hammer.
Figure 13:
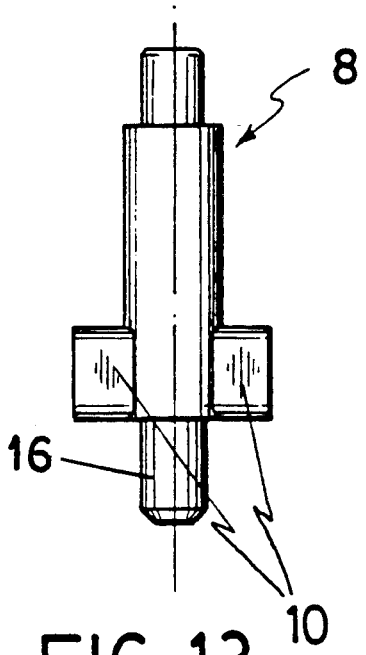
FIG. 13. It is a raised view of the firing hammer.
Figure 14:
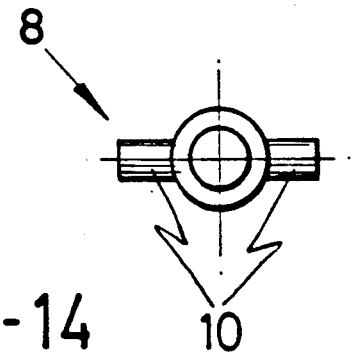
FIG. 14. It is a plan view of the firing hammer.

The firing hammer 8 whose geometry can be clearly seen in FIGS. 13, 14 and 15 has a scaled cylindric section and also has the projections 10 in diametric opposition and which define the retention means of the firing hammer 8 in the position farthest from the piezoelectric element 3, upon remaining locked in the lateral grooves 11 which open up on one of the sides of the longitudinal grooves 12 foreseen in diametric opposition in the tubular body 1, in which the transversal or diametric projections play.

Figure 1:
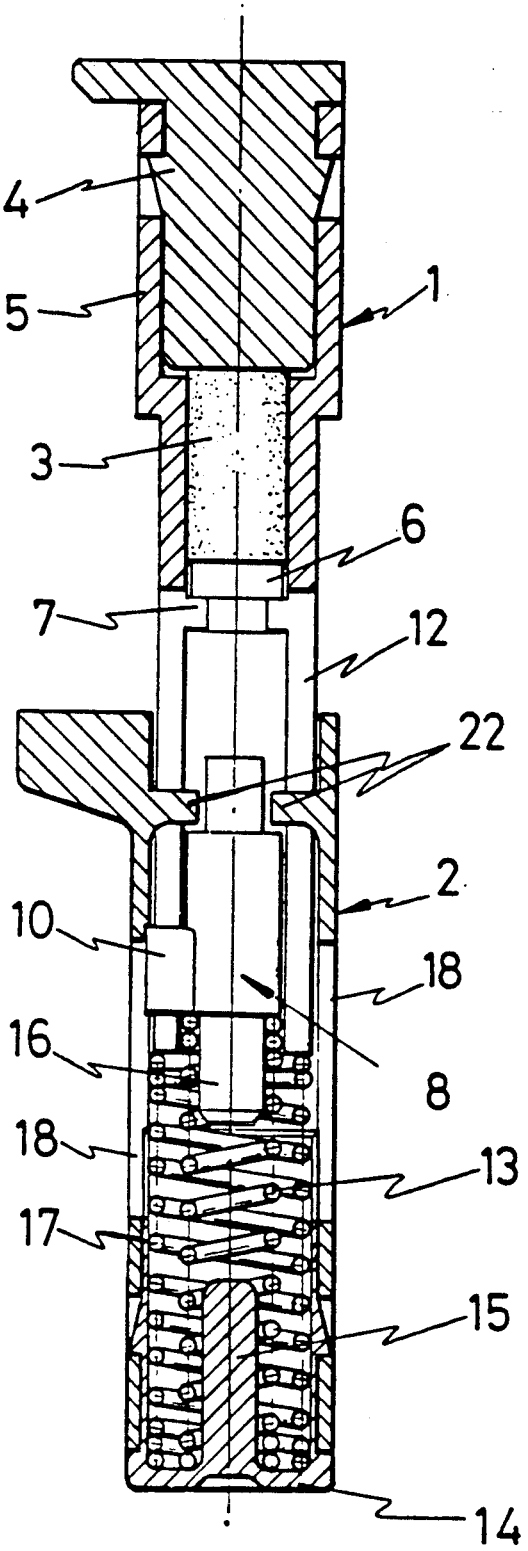
FIG. 1. It is a raised longitudinal section of the piezoelectric mechanism for gas lighters, object of the invention, in the set position.
Figure 2:
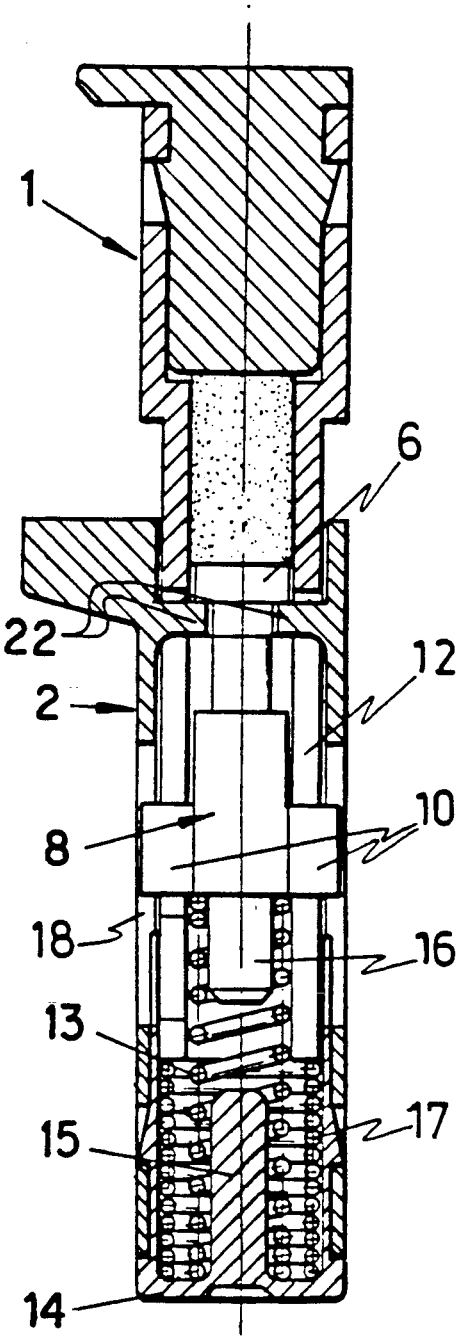
FIG. 2. It is a view similar to FIG. 1 in the firing position.
Figure 3:
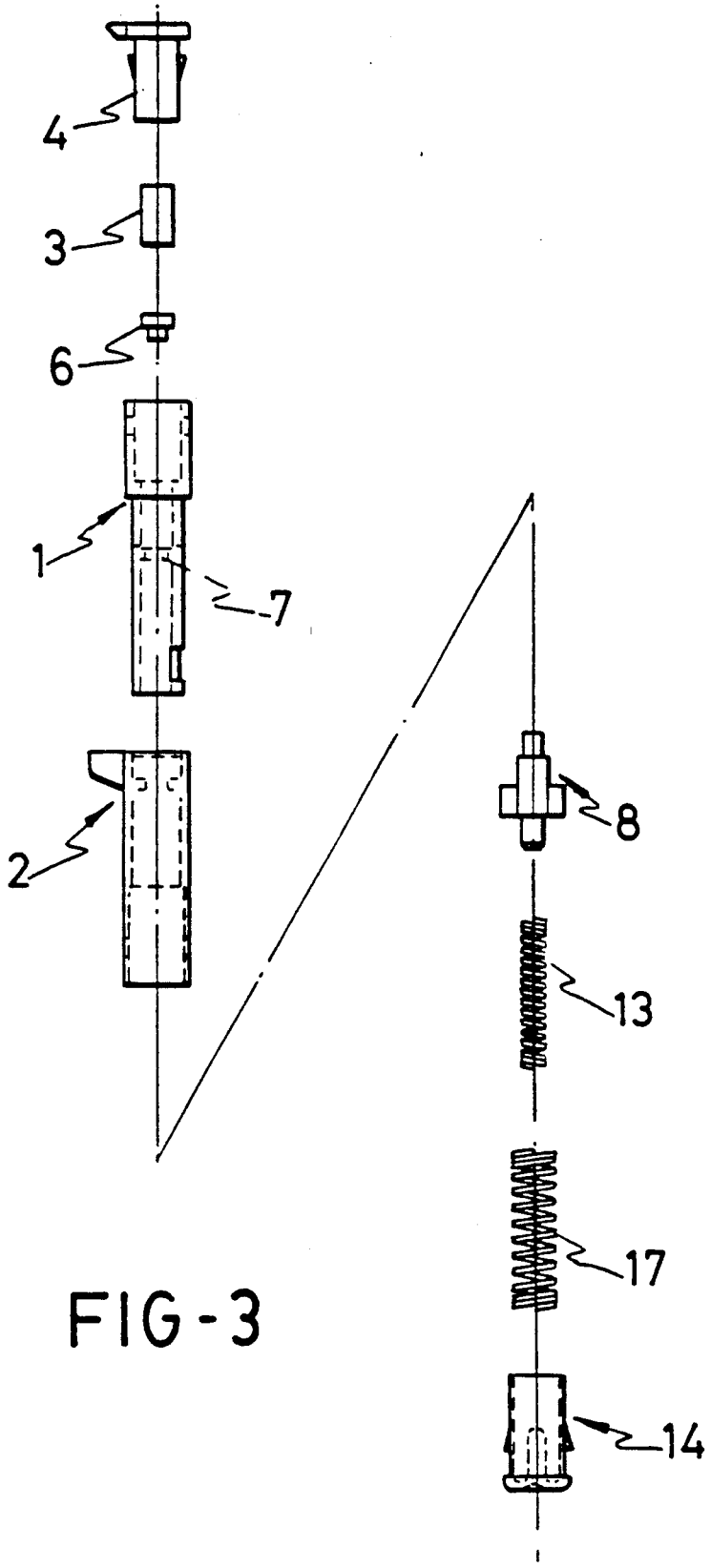
FIG. 3. It is an exploded raised view of all the components of the piezoelectric mechanism.
Figure 5:
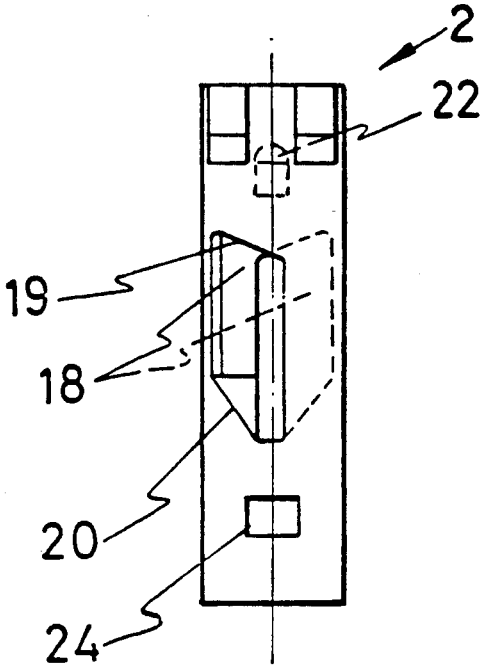
FIG. 5. It is a side raised view of what is shown in FIG. 4.
Figure 4:
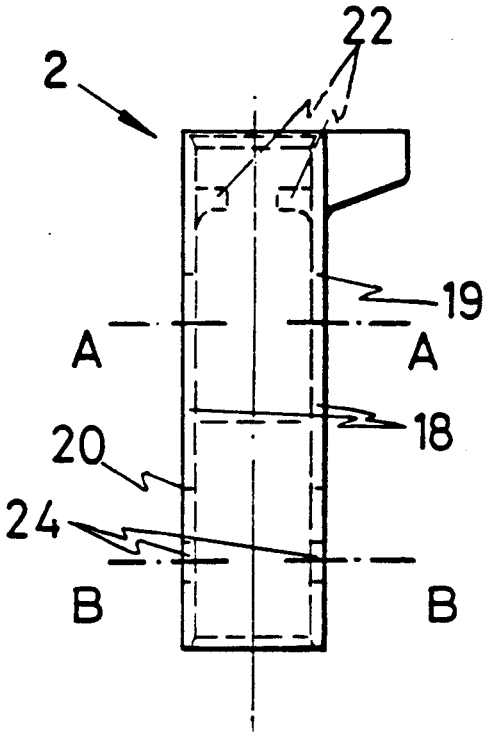
FIG. 4. It is a raised view of the outside telescopic body.
Figure 8:
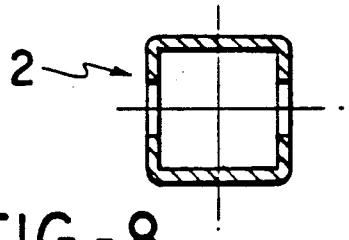
FIG. 8. It is a section along the cutting line B—B of FIG. 4.
Figure 6:
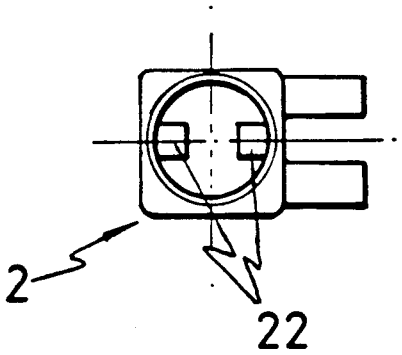
FIG. 6. It is a plan view of what is shown in FIG. 4.
Figure 7:
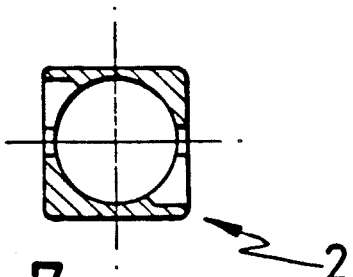
FIG. 7. It is a section along the cutting line A—A of FIG. 4.
Figure 12:
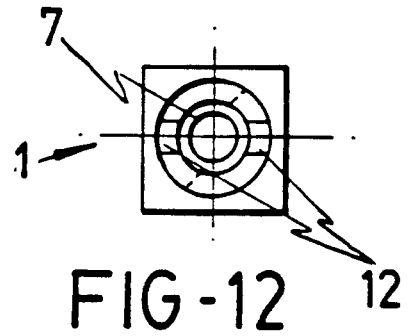
FIG. 12. It is a bottom plan view of what is shown in FIG. 9.

As is observed in FIGS. 1 and 2, the firing hammer 8 is aided by a spring 13 which rests on the bottom of the cover 14 solidly connected to the outside telescopic body 2. The spring 13 remains guided by both ends in the cylindric shanks of the cover 14 and the firing hammer respectively.

On their part, the telescopic bodies 1 and 2 are also aided by a coaxial spring 17 which wraps around the other spring 13, which also rests on the bottom of the cover 14 and in such a way that its active end establishes a support on the annular edge of the inside telescopic body 1, with which said spring 17 keeps the telescopic unit in the position of maximum extension, limited by a stop which is described later on.

As we have indicated above, the firing hammer 8 can move axially in the cylindric hole of the inside telescopic body 1 and in such a way that the diametric projections 10 of the same are guided in the diametrically opposite longitudinal grooves. So that the firing hammer 8 can be retained in the position far from the piezoelectric element 3 and the projections 10 be lodged in the respective lateral notches 11 close to the end of the inside tubular portion 1, it is necessary that said firing hammer 8 make a rotation, simultaneously lodging the projections 10 in the notches 11 upon being located in the same direction of rotation on one side of the respective longitudinal groove 12.

Figure 10:
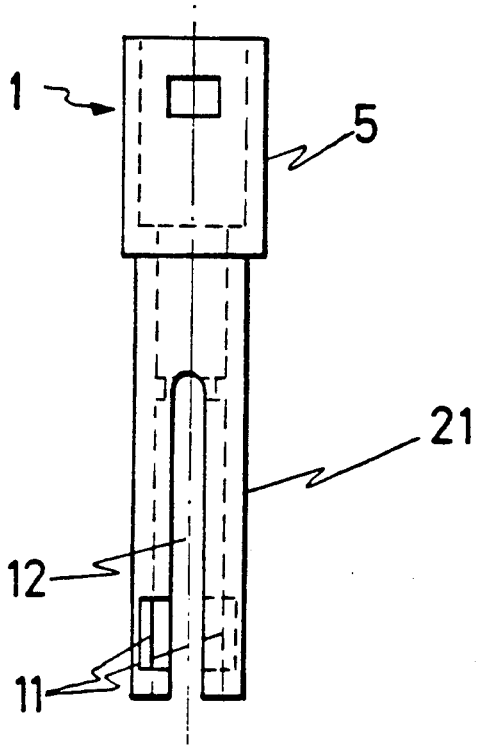
FIG. 10. It is a side raised view of what is shown in FIG. 9.

This rotation of the firing hammer takes place thanks to the existence of the windows 18 made in two of the opposite walls of the telescopic outside body 2 (see FIGS. 4 to 8.) The top edge 19 of the window 18 is oblique in order to define a ramp which forces the respective projection 10 of the firing hammer 8 to turn when it reaches the end of the longitudinal groove 12 where there is the corresponding side notch 11, which takes place in the rest position of the telescopic unit, coinciding with the one of maximum extension of the bodies 1 and 2. This position of maximum extension is limited by the lowest edge of the notch, according to the position shown in FIGS. 9 and 10. This position is obtained automatically thanks to the ramp 19.

In order to get the firing hammer 8 to knock hard against the stop piece 6, aided by its spring 13 to cause the spark piezoelectrically, the diametric projections 10 thereof have to leave their housing in the inside of the side notches 11, once said spring 13 has been pressed since in the rest position it is released, just like the casing spring 17. This is obtained upon compressing on the telescopic unit in which both springs 13 and 17 are compressed and during this run the projections 10 of the firing-hammer 8 move away from the edge of the respective window 18, until the opposite edge 20 (see FIG. 5) incides on said projection and forces it to come out of its lodging in the side notch 11 precisely due to the oblique position or ramp position of this edge 20, after which the percussion takes place.

The telescopic displacement of the bodies 1 and 2 is presently guided in order to prevent them from rotating between themselves, since the outside contour of the portion of the inside body 1 which plays in the axial cylindric recess 2 of the outside telescopic body 9 referred to as 21 in the figures, is also cylindric and with a diameter adjusted to the latter. These nonrotation means for the telescopic unit are determined by the pair of ribs 22 which emerge from diametrically opposite points of the cylindric surface of the axial recess of the outside body 2, which are lodged and run along the same longitudinal grooves 12 of the telescopic body 1 in which the diametric projections 10 of the firing hammer 8 are guided.

Figure 17:
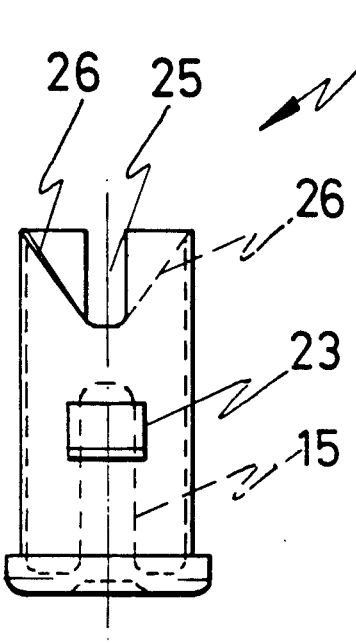
FIG. 17. It is a side raised view of what is shown in FIG. 16.
Figure 16:
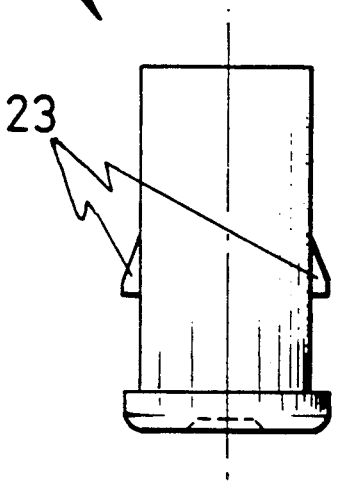
FIG. 16. It is a raised view of the cover of the outside telescopic body.
Figure 18:
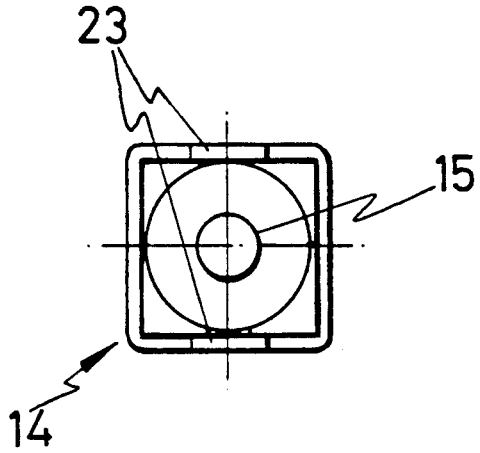
FIG. 18. It is a plan view of what is shown in FIG. 17.

In FIGS. 16 to 18 one can see the geometric form of the cover 14, which remains solidly connected to the outside telescopic body 2. This is achieved upon the latter having a square outside contour which adapts close to the inside, which is also square, of the corresponding end portion of the body 2 (see FIGS. 4 and 8.) The solid hooking is attained upon there being between these elements anchoring means defined by the ribs 23 in spear and windows 24 which collect them.

The cover 14 is also affected by a pair of opposite grooves 25 in order to prevent that the walls of the cover where they are made from interfering with the longitudinal grooves 12 of the inside telescopic body 1. Besides, on one side of the grooves 25 and in the same direction of rotation, there are both oblique sections 26 with the same inclination as the edges 20 of the windows 18 of the outside telescopic body 2, these sections which have been made for the same purpose as the grooves 25, that is to say in order not to partially obstruct the respective windows 18. The inside periphery of the cover 14 is cylindric and from its bottom the guide shank 15 of the inside spring 13 emerges.

The assembly of the mechanism can be effected by previously mounting the stop piece 6, the piezoelectric element and the anvil 4 through the inside telescopic body 1. The springs 13 and 17 can be previously mounted in the inside of the cover 14 in such a way that the inside spring 13 remains anchored to the shank 15 of the cover and the other end of said spring 13 does so in the shank 16 of the firing hammer 8; the spring 17 remaining without axial since it contacts in its free end with the diametric projections 10 of the firing hammer 8.

Then the last mentioned unit can be mounted over the outside telescopic body 2 until the cover 14 remains correctly anchored. The total length of the diametric projections 10 of the firing hammer 8 does not imply any difficulty for the introduction of this front unit into the outside body 2, since said projections 10 very soon reach the windows 18 and do not exceed the outside side surfaces of said body 2.

Finally, or simultaneously to the connecting of the cover the telescopic plugging of both bodies 1 and 2 can be effected until the projections 10 of the firing hammer 8 automatically lodge in the respective side notches 11.

Now returning to FIG. 2 in which the lighting position is represented, when the pressing which the user has ended, the telescopic bodies 1 and 2 extend due to the action of the spring 17 which had been pressed during the contraction of the telescopic unit, simultaneously as had been pressed on the spring 13 which aids the firing hammer 8.

Figure 19:
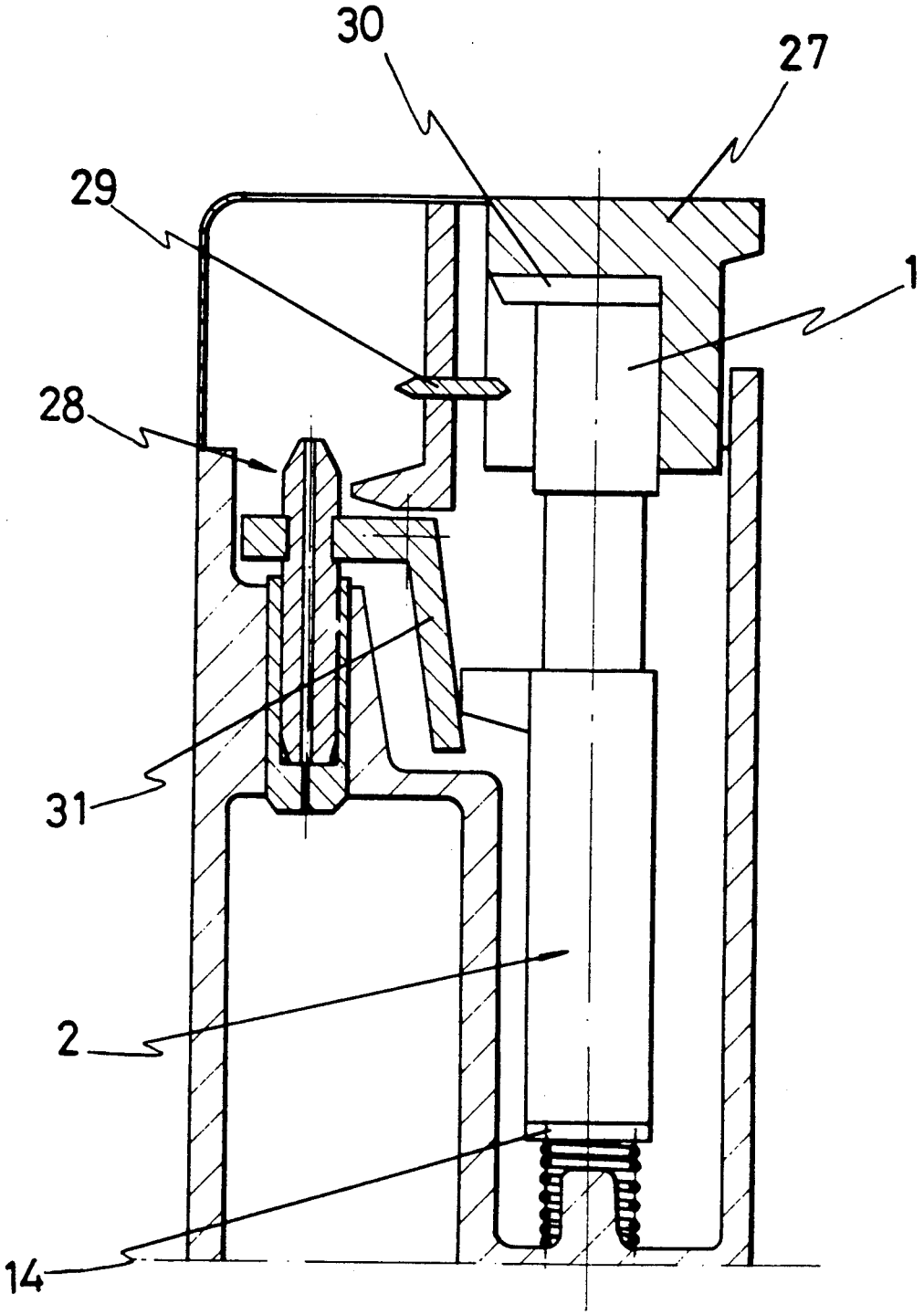
FIG. 19. It is a longitudinal raised partial section of a pocket lighter which includes the piezoelectric mechanism object of the invention.

In FIG. 19 we can see the mechanism object of the invention coupled to a piezoelectric lighter. Upon pushing the button 27 first the gas comes out of the burner 28 and then the spark is caused which jumps between the conductor element 29 and the mouth of the burner 28. The electric circuit closes when the appendix 30 of the anvil 4 contacts with said conductor element 29 and the mouth 31 with the body 2.

The cotters or guide ribs 22 of the outside telescopic body 2 aside from carrying out this function, are also used as contactor in the moment of firing in order to reduce the resistance and close the electric circuit, thus the electric circuit is short and thus there is a minimal loss of charge, since the electric current only circulates through pieces 4, 3, 6, 2 and from here to the conductor fork 31 and conductor burner 28. The current does not pass through the springs 13 and 17 as happens in other present day mechanisms. Besides, since the electric current does not run through the outside body beyond the contacts defined by the cotters 22, the cover 14 can be made out of a non-conductive material and therefore more cheaply, as we had pointed out at the beginning of this specification.

I claim:

1. A piezoelectric mechanism for gas lighters, comprising:

a first generally hollow body and a second generally hollow body, said first body being telescopically received in said second body, said bodies being translatable relative to each other along a longitudinal axis, said second body including a pair of ribs extending diametrically toward said axis from opposite sides of said second body, said first body having longitudinal grooves wherein said ribs are guided during relative translation of said first and second bodies, the relative axial orientation of said first and second bodies being fixed at least by said ribs guided by said longitudinal grooves;

a hammer slidable along said axis within said first body, said hammer having diametric projections subject to guidance within said longitudinal grooves of said first body;

an anvil fixed in said first body at a longitudinal position away from said second body;

a piezoelectric element having two ends and fixed in said first body with one said end adjacent to said anvil;

a stop piece fixed in said first body and adjacent to the other said end of said piezoelectric element, said stop piece opposing said hammer;

a removable cover for closing the end of said second body, said closable end being away from said first body;

a first spring within said second body, said first spring resting at one end against said cover and at the other end against said first body, said first spring urging said first and second bodies to a least-telescoped position, said least-telescoped position being a stand-by condition;

a second spring within said second body, said second spring resting at one end against said cover and at the other end against said hammer to urge said hammer toward said stop piece, said hammer and stop piece being spaced apart in said stand-by condition, said first body further including notches away from said anvil at the ends of said longitudinal grooves, said hammer projections being constrained in said notches in said stand-by condition, said second body including windows on opposite walls thereof, said windows having ramped edges, said hammer projections extending through said notches in said first body in said stand-by condition to be guided by said windows, compression of said first body from said stand-by condition into said second body causing said springs to compress, action of said ramped window edges on said hammer projections concurrently causing said hammer to rotate about said axis, said hammer projections being guided from said first body notches into alignment with said first body longitudinal grooves, whereby said hammer is released to impact with said stop piece, said hammer being guided by said longitudinal grooves and propelled by said compressed second spring.

2. A piezoelectric mechanism for gas lighters as in claim 1, wherein said windows of said second body extend in an axial direction, said closable end of said second body being square in cross section, said hammer being insertable into said second body through said closable end when said cover is removed, the length of said hammer projections requiring orientation corner-to-corner of said square cross section for entry into said second body.

3. A piezoelectric mechanism for gas lighters as in claim 1, wherein said cover is telescopically received within said second body to cover said closable end, said cover including a pair of opposite grooves for alignment with said longitudinal grooves of said first body when said cover and said first body are respectively telescoped into said second body, said cover further including oblique sections on one side of each said groove in said cover, said oblique sections being contoured to align with said ramped edges of said windows in said second body when said cover is telescoped into said second body.

* * * * *